US007252429B2

(12) United States Patent
Yungblut

(10) Patent No.: US 7,252,429 B2
(45) Date of Patent: Aug. 7, 2007

(54) ROTARY FLUID AGITATOR

(76) Inventor: John David Yungblut, 4349 A Airport Cres, Vermillion, Alberta (CA) T2X 1P4

( * ) Notice: Subject to any disclaimer, the term of this patent is extended or adjusted under 35 U.S.C. 154(b) by 440 days.

(21) Appl. No.: 10/869,374

(22) Filed: Jun. 17, 2004

(65) Prior Publication Data

US 2005/0281131 A1 Dec. 22, 2005

(51) Int. Cl.
*B01F 15/02* (2006.01)
*B01F 7/16* (2006.01)

(52) U.S. Cl. ..... 366/169.1; 366/172.1

(58) Field of Classification Search ..... 366/167.2, 366/168.1, 172.1, 173.1, 173.2, 169.1, 170.3, 366/170.4, 136, 137
See application file for complete search history.

(56) References Cited

U.S. PATENT DOCUMENTS 434,538 A * 8/1890 Byrne ..... 366/172.1
742,385 A * 10/1903 Blaisdell ..... 366/169.1
1,391,013 A * 9/1921 Schwager ..... 366/170.4
2,559,518 A * 7/1951 Smith ..... 366/134
2,592,904 A * 4/1952 Jackson ..... 366/168.2
3,402,725 A * 9/1968 Booth ..... 134/167 R
3,981,315 A * 9/1976 Olthoff ..... 134/167 R
4,168,918 A * 9/1979 de Jonge ..... 366/138
4,376,515 A * 3/1983 Soe ..... 241/101.8
4,986,293 A * 1/1991 Schertenleib ..... 134/168 R
5,078,799 A * 1/1992 Matter et al. ..... 134/22.18
5,558,434 A * 9/1996 Hamada et al. ..... 366/137
6,321,754 B1 * 11/2001 Manabe et al. ..... 134/22.12

* cited by examiner

*Primary Examiner*—Tony G. Soohoo
(74) *Attorney, Agent, or Firm*—Bay Area Patent Group, LLC; Stephen Lewellyn

(57) ABSTRACT

A rotary fluid agitator is provided. The rotary fluid agitator essentially comprises a fluid conduit that is positioned vertically within a storage tank holding a quantity of fluid, such as a drilling fluid. At least one nozzle is attached to the fluid conduit for jetting a stream of fluid into to the fluid contained within the tank. A drive means is connected to the fluid conduit and rotates the conduit to sweep the nozzle through a 360-degree arcuate path at a predetermined rotational frequency. A fluid pump is attached in fluid communication with the interior volume of the tank and pumps a quantity of drilling fluid through a fluid circulation line and through the fluid conduit to be jetted out of the nozzle. As the nozzle is swept through the arcuate path a conically shaped fluid flow path is created in the fluid contained within the tank causing the jetted fluid to tangentially act upon the fluid thereby keeping all solid particulates mixed with the fluid in suspension.

6 Claims, 2 Drawing Sheets

ROTARY FLUID AGITATOR

BACKGROUND OF THE INVENTION

1. Field of the Invention

The present invention relates generally to an improved means of mixing, stirring and maintaining solids in suspension in a liquid. More particularly, relating to an apparatus for maintaining in suspension a complex drilling fluid mixture during storage of the drilling fluid within a storage tank.

2. Background of the Invention

In the operations carried out to drill a borehole through a formation a mixture of chemical, water or oil, and solids such as bentonite, barite and drilled formation particulates, referred to as "drilling fluid" or "drilling mud" is circulated down through a drill string, and through a drill bit where the mixture performs a number of important functions. Such functions include cooling the drill bit, lubricating the drill bit, flushing formation cuttings from the face of the drill bit and then transporting the formation cuttings up annulus between the drill string and the wall of the borehole to the surface of the borehole. At the surface, the drilling fluid containing the formation cuttings is directed through a flow line to a separating device, such as a vibrating screening device know as a "shale shaker" where most but not all of the formation cuttings are separated from the drilling fluid. The drilling fluid then enters a settling tank after passing through the "shale shaker" where a portion of the remaining suspended formation cuttings settle to the bottom.

From the settling tank the drilling fluid flows into the first of one or more storage/suction tanks. When it is necessary to add chemicals, water or oil, and desirable solid to the drilling fluid to adjust or maintain the desired properties of the drilling fluid, they are added through the storage/suction tanks. Normally the storage/suction tanks are fitted with agitators consisting of two large flat fan type blades mounted on a vertical heavy pipe or steel shaft at fixed predetermined distances from the bottom of the tank, The blades rotate at a fixed speed and as a results of the action of the blades on the drilling fluid, the fluid first moves vertically up and then with the effect of gravity down in a circular motion which causes the solids in close vicinity of the blades to remain in suspension. However, there is a significant portion of the fluid in the tank that s not affected by the rotation of the blades, particularly long the perimeter of the tank and solids tend to settle and build up there. The usual way of correcting or compensating for this lack of effectiveness in keeping the solids in suspension is to employ manually manipulated guns to inject fluid through a nozzle at a high velocity into the tanks causing the drilling fluid to roll. This method is effective in putting the drilling fluid in motion and putting and keeping the solids in suspension. However, it has the disadvantage of requiring a worker to be stationed at each tank to operate the gun. As a result it is only practical to use this technique intermittently and as a result solids settle to the bottom of the tanks where they are difficult to reintegrate into the drilling fluid.

There are many deficiencies with the current preferred system. First, is that the useful and valuable solids in the drilling fluid settle to the bottom of the tanks along with the formation cuttings and can not be picked up by the pump suction to be properly processed by the drilling fluid "centrifuge" or the "desander" where the high cost drilling fluid and including most of the desirable solids are separated from the undesirable formation cuttings. This results in some of the high cost drilling fluid being discarded along with the formation cuttings during or at the end of the well. Second, the build up of solids in the storage/suction tanks results in a lengthy, difficult manual cleaning of each tank at regular intervals during the drilling of a borehole. Third, more chemicals and more beneficial solids must be used to maintain the properties of the drilling fluid in the optimum range than what would be required if the drilling fluids in the tanks could be mixed and agitated in a manner that would keep all solids, both the beneficial and undesirable solids in suspension.

It should be noted that drilling fluids are very expensive sophisticated substances whose properties such as viscosity, density, shear resistance and stability must be carefully and accurately maintained and controlled. Unwanted formation cutting solids in the fluid make it more difficult to manage the properties.

SUMMARY OF THE INVENTION

In accordance with the present invention, a rotating fluid agitator for stirring, mixing and agitating a drilling fluid contained within a storage tank is provided. The invention provides a means of agitating and mixing the drilling fluids with an unattended jet stream of fluid whose direction, velocity and speed of rotation can be adjusted to the optimum values taking into account the viscosity and density of the drilling fluid as well as the interior volume of the storage tank.

The rotary fluid agitator essentially comprises a fluid conduit that is positioned vertically within a storage tank holding a quantity of fluid, such as a drilling fluid. At least one nozzle is attached to the fluid conduit for jetting a stream of fluid into to the fluid contained within the tank. A drive means is connected to the fluid conduit and rotates the conduit to sweep the nozzle through a 360-degree arcuate path at a predetermined rotational frequency. A fluid pump is attached in fluid communication with the interior volume of the tank and pumps a quantity of drilling fluid through a fluid circulation line and through the fluid conduit to be jetted out of the nozzle. As the nozzle is swept through the arcuate path a conically shaped fluid flow path is created in the fluid contained within the tank causing the jetted fluid to tangentially act upon the fluid thereby keeping all solid particulates mixed with the fluid in suspension.

In additional embodiments, several nozzles can be include to increase the action performed upon the drilling fluid or in addition to the nozzles, an agitating turbine blade and can be included.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. As such, the present invention can be used in many other applications where it is desired to keep solids in suspension within a fluid in addition to drill fluid. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENTS

Figure 1:
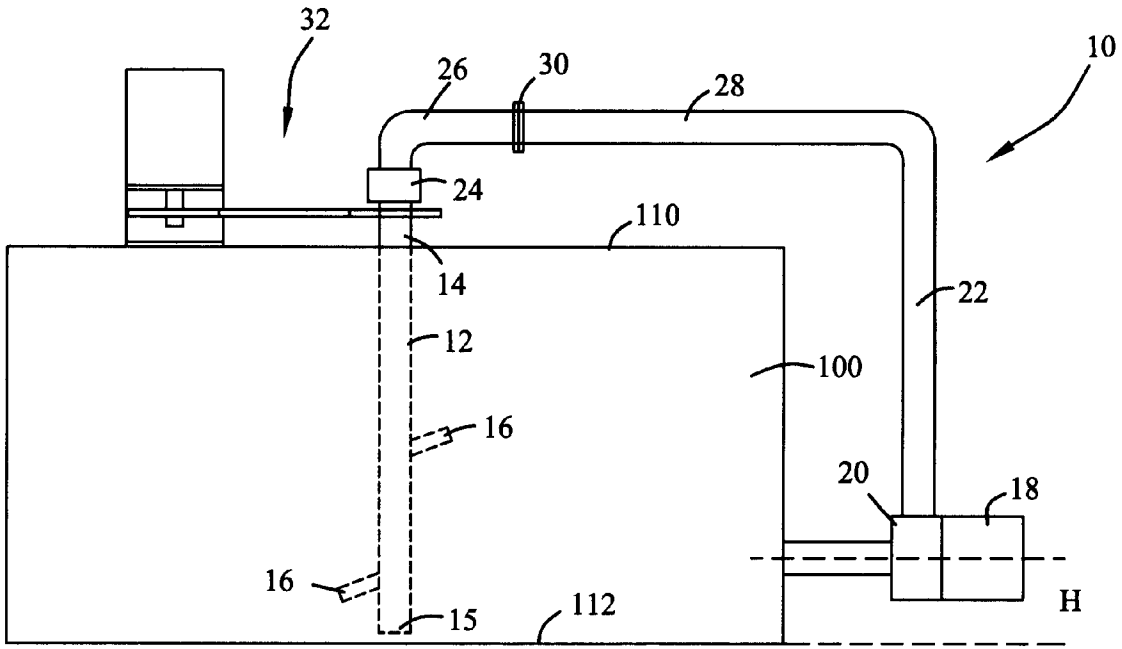
FIG. 1 is a schematically view of the a preferred embodiment of the rotary fluid agitator constructed in accordance with the principles of the present invention.
Figure 3:
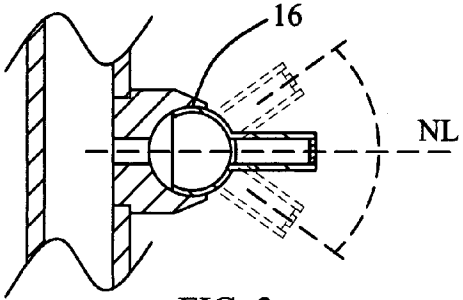
FIG. 3 is an enlarged detail view of a nozzle.
Figure 2:
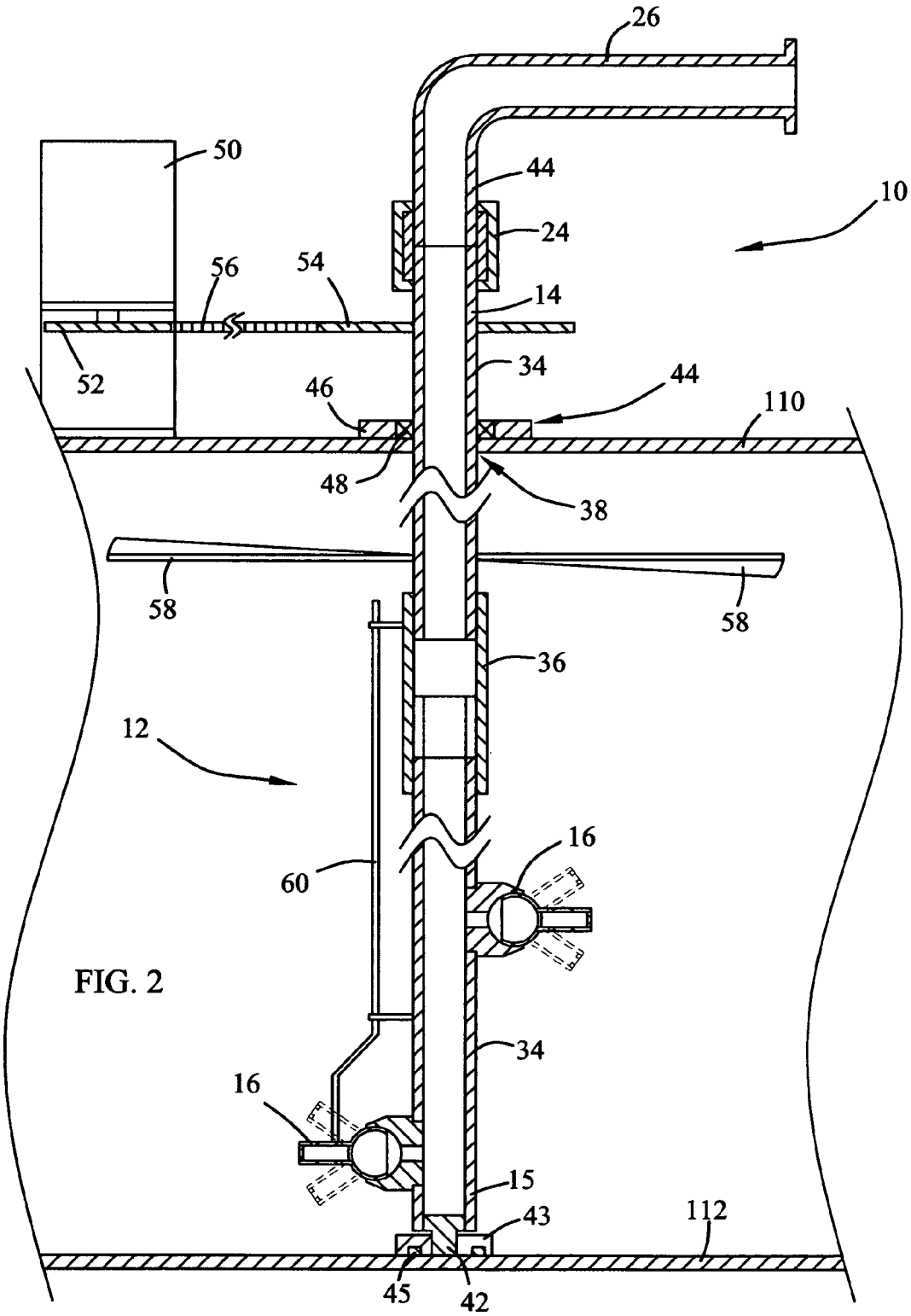
FIG. 2 is a cross section view of the rotary fluid agitator of a preferred embodiment of the present invention.

Referring now to the drawings, and particularly to FIGS. 1-3, a preferred embodiment of the rotary fluid agitator of the present invention is shown and generally designated by the reference numeral 10. It is important to note, the design of the rotary fluid agitator 10 is that so not only are solid particulates mixed with a fluid are maintained in suspension, but so that the number of elemental parts of the rotary fluid agitator which are placed in contact with the fluid is a minimum to reduce contamination to the fluid by the elemental parts. Additionally, the present invention is designed to reduce operation wear resulting from abrasion created by the suspended solids. This design will become apparent upon reading the remaining disclosure.

Reference is first made to FIG. 1 which schematically illustrates the rotary fluid agitator 10 and a fluid storage tank 100. The tank 100 is a typical tank used to contain fluids, such as drilling fluids and which has an interior volume and at least a top surface 110 and a bottom surface 112. The rotary fluid agitator includes a fluid conduit 12 having a first end 14 and a closed second end 15 that is positioned vertically within the tank 100 with the second end approximate the bottom surface 112 and the first end 14 extending through and above the top surface 110. At least one nozzle 16 is connected to the fluid conduit 12 at a predetermined elevation along the height of the conduit and is directed to jet a stream of fluid into the interior volume of the tank to act upon the fluid contained therewithin to create a turbulent flow within the fluid to remain in suspension solid particulates mixed with the fluid.

A pump 18 having a pump head 20 is connected to the tank 100 in fluid communication with the interior volume at a predetermined height H above the bottom surface 112 and draws fluid from within the tank and pumps the fluid through a fluid circulation line 22 which is connected at one end to the pump head and at a second end to the first end 14 of the fluid conduit 12 by a sealed rotary coupling 24. The fluid circulation line 22 can be of two sections 26 and 28 which are connected together at flange 30. This construction will allow easy removal of the fluid conduit 12 from the tank 100 for servicing and adjustment.

A drive means 32 is attached to the first end 14 of the fluid conduit 12 and imparts axially rotational movement to the fluid conduit so as to rotate the fluid conduit and sweep the nozzle or nozzles through a 360 degree arcuate path at an adjustable angular frequency.

Turning now to FIG. 2, a more detailed description of the essential elements of the rotary fluid agitator 10 will be had. More particularly, the fluid conduit 12 is a pipe consisting of one or more sections 34. If more then one section 34 is used, successive sections are connected end-to-end by a sleeve 36, thereby affording a degree of adjustability to the length of the fluid conduit 10. The sleeve 36 can be a splined sleeve. The first end 14 of the fluid conduit extends through an aperture 38 formed through the top surface 112 of the tank 100. The second end 15 is closed off by a plug 40, such as a bullnose plug having a projection 42 which is received by a collar 43 attached to the bottom surface 114 of the tank, thereby restricting the fluid conduit 10 to axially rotation. The collar 43 can be releasably attached to the bottom surface 114 by the use of a magnetic source 45, such as a permanent magnet. The first end 14 is supported by a bearing assembly 44 that is attached to the top surface 112 of the tank 100. The bearing assembly 44 includes a collar 46 fitted with a rotary thrust bearing 48 which is in contact with the exterior surface of the fluid conduit 12.

A sealed rotary coupling 24, such as a sealed rotary slip joint, is fitted to the first end 14 of the fluid conduit 12, which adjoins the first end of the fluid conduit to an end 44 of the fluid circulation line 22 so that the fluid conduit remains in a fluidic connection with the end of the fluid circulation line through the axial rotation of the fluid conduit.

A nozzle 16 or a plurality of nozzles 16 are connected in fluid communication to the fluid conduit 10 at predetermined fixed intervals along the length thereof. The nozzles 16 project from the fluid conduit 10 into the interior volume of the tank 100 and are directed to jet fluid therefrom to act upon the fluid contained within the tank. Referring to FIG. 3, preferably, the nozzles 16 are adjustable through an arcuate path parallel to the axially direction of the fluid conduit 12. Most preferably, the arcuate path is of about 60 degrees: 30 degrees thereof being above a normal line NL taken axially through the nozzle 16 when the nozzle is oriented normal to the fluid conduit 12 and 30 degrees being below the normal line. An arcuate path of 60 degrees ensures each nozzle can not be adjusted out of an effective jetting orientation.

A drive means 32 for imparting axially rotational movement to the fluid conduit 12 is attached thereto at the first end 14. The drive means rotates the fluid conduit at a predetermined angular frequency thereby sweeping each nozzle 16 through a 360 degree arcuate path. Preferably, the angular frequency is from about 30 revolutions per a minute (RMP) to about 100 RPM. Essentially, each nozzle 16 is adjusted at a predetermined angle off the normal line NL so that a jet of fluid is swept through the fluid contained within the tank 100 creating a turbulent conical shaped fluid flow path in space within the fluid contained in the tank 100. The conical shaped fluid flow path impinges upon the fluid mixture at an angular direction with respect to the bottom and top surface of the tank 100 thereby ensuring all particulate solids in suspension with the fluid remain in suspension. In addition, the edge of the conical shaped fluid flow path develops eddy currents eliminating the settling of solids on the bottom surface 114 of the tank 100. The nozzles 16 can be adjusted so that each conical shaped fluid flow partially overlaps or so that they are opposed. The adjustment would be predicated upon the mixture of fluid and the overall volume and shape of the tank 100.

One possible example of the drive means 32 can include a motor 50 attached to the tank 100, a first sprocket 52 attached to the drive shaft of the motor, a second sprocket 54 attached to the first end 14 of the fluid conduit 12 and an endless chain 56 connected to the first and second sprockets. Preferably, the motor is a low voltage direct current motor to reduce the risk of electrical shock. The speed of the motor can be controlled by an electrical controller or by a potentiometer. A gear drive or a belt drive system could also be implemented as the drive means 32.

In an additional embodiment, the fluid conduit 12 can be fitted with a plurality of turbine blades 58 to develop an upward swell within the fluid contained in the tank 100 which is created tangential to the conically shaped fluid flow paths created by the jetted fluid from the nozzles 16, thereby increasing the action upon the fluid to help remain in suspension solid particulates mixed with the fluid.

Figure 4:
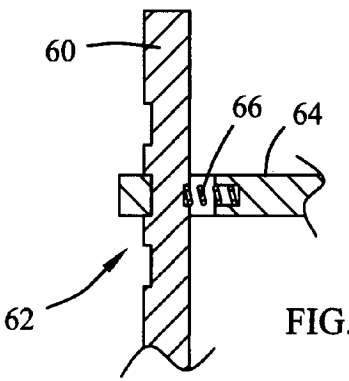
FIG. 4 is an enlarged detail view of a section of the nozzle control rod.

Referring to FIGS. 2 and 4, an adjustment rod 60 for adjusting the angle of each nozzle 16 may be include. One end of the rod 60 is attached at the nozzle 16 with the opposite end extending upwardly therefrom. Preferably, the rod 60 includes a series notches 62 which are positively engaged with a rod support member 64 by a spring element 66, such as a compression spring. To adjust the angular displacement of the nozzle 16, an operator simply operates the rod 60 to over come the force of the spring element 66 and either raises or lowers the rod to adjust the angle of the nozzle.

A number of embodiments of the present invention have been described. Nevertheless, it will be understood that various modifications may be made without departing from the spirit and scope of the invention. Accordingly, other embodiments are within the scope of the following claims.

I claim:

1. A rotary fluid agitator for keeping in suspension a mixture of fluid and solid particles contained within a fluid storage tank having an interior volume and at least a top surface and a bottom surface, the rotary fluid agitator comprising in combination:

a rotatingly driven fluid conduit positioned vertically within the interior volume of the tank, said fluid conduit having a first end extending upwardly through the top surface of the tank and a second closed end positioned approximate to and restrained to rotate about the bottom wall;

one or more spray nozzles attached to said fluid conduit in fluid communication therewith and projecting therefrom into said volume of said tank, said first spray nozzle oriented to jet a fluid into said interior volume;

one or more adjustment rods attached to each of said one or more spray nozzles respectively, each of said adjustment rods extending upwardly from its respective spray nozzle so as to be graspable by an operator to adjust the angle of said spray nozzle respective to a normal line that is perpendicular to fluid conduit;

a drive means attached to said fluid conduit for axially rotating said fluid conduit and sweep said one or more spray nozzles through a 360 degree rotation at a predetermined rotational frequency; and a fluid pump operating to circulate fluid from the tank through said fluid conduit and said one or more spray nozzles.

2. The rotary fluid agitator of claim 1, further comprising:

a collar attached to the bottom surface of the tank and rotatably receiving said second end of said fluid conduit.

3. The rotary fluid agitator of claim 2, wherein said collar is magnetically attached to the bottom surface of the tank.

4. The rotary fluid agitator of claim 1, further comprising:

a turbine blade mounted on said fluid conduit and extending radially therefrom into the volume of the tank.

5. The rotary fluid agitator of claim 1, wherein said fluid conduit is comprised of more than one conduit section connected end-to-end by a splined sleeve.

6. The rotary fluid agitator of claim 1, wherein said one or more adjustment rods include a series of notches which are positively engaged with a rod support member by a spring element.

* * * * *